United States Patent [19]

Fronduti

[11] Patent Number: 4,671,449

[45] Date of Patent: Jun. 9, 1987

[54] PARALLELEPIPEDIC CONTAINER OBTAINED FROM ONE-PIECE BLANK HAVING ROTATABLE CLOSURE OPERATED BY INNER AND OUTER SLIDABLE CASINGS

[75] Inventor: Domenico Fronduti, Città di Castello, Italy

[73] Assignee: Cartotecnica Tifernate S.p.A., Citta di Castello, Italy

[21] Appl. No.: 787,767

[22] Filed: Oct. 15, 1985

[30] Foreign Application Priority Data

Oct. 15, 1984 [IT] Italy ..... 49010 A/84

[51] Int. Cl.[4] ..... B65D 5/38

[52] U.S. Cl. ..... 229/19; 206/540; 229/9

[58] Field of Search ..... 229/9, 11, 19, 20; 206/538, 540; 221/305

[56] References Cited

U.S. PATENT DOCUMENTS

| | | | |
|---|---|---|---|
| 1,185,560 | 5/1916 | Walcutt | 229/20 |
| 1,247,332 | 11/1917 | Rodgers | 229/20 |
| 1,486,301 | 3/1924 | Rodgers | 229/11 |
| 1,928,889 | 10/1933 | Guyer | 229/20 |
| 2,030,797 | 2/1936 | Knauth | 229/20 |
| 2,377,472 | 6/1945 | Glover | 229/11 |
| 2,497,455 | 2/1950 | Johnson | 229/20 |
| 2,950,060 | 8/1960 | Von Rudeen | 229/20 |
| 3,160,342 | 12/1964 | Murdock et al. | 229/20 |
| 3,773,245 | 11/1973 | Meyers et al. | 229/20 |

FOREIGN PATENT DOCUMENTS

| | | | |
|---|---|---|---|
| 732939 | 4/1966 | Canada | 229/20 |
| 386577 | 1/1933 | United Kingdom | 229/19 |

*Primary Examiner*—William Price
*Assistant Examiner*—Gary E. Elkins
*Attorney, Agent, or Firm*—Fleit, Jacobson, Cohn & Price

[57] ABSTRACT

A parallelepiped container, in particular for loose confectionery products such as chocolates, caramels, tablets, sugar-coated pills or the like, which is formed from a flat, one-piece, die-cut blank by folding the constituent panels and end flaps of the flat blank along prearranged creasing lines, and sticking together prearranged zones, in such a manner as to obtain the container in the form of two parts which are axially slidable in the manner of a drawer one inside the other, the sliding causing mobile end panels of the container to rotate in order to open and/or close it.

4 Claims, 8 Drawing Figures

PARALLELEPIPEDIC CONTAINER OBTAINED FROM ONE-PIECE BLANK HAVING ROTATABLE CLOSURE OPERATED BY INNER AND OUTER SLIDABLE CASINGS

BACKGROUND OF THE INVENTION

The present invention relates to a container for loose products in general, and in particular for confectionery products such as chocolates, caramels, tablets, sugar-coated pills or the like, formed from a flat, one-piece, die-cut blank, for example of cardboard, by folding along prearranged creasing lines, and such as to assume a substantially parallelepiped shape when assembled.

The object of the present invention is to provide a container which can be opened in a comfortable and simple manner for removing the required quantity of product and closed in a likewise comfortable and simple manner when the product has been removed, and which for obvious hygienic and other reasons also prevents accidental escape of the product contained therein.

SUMMARY OF THE INVENTION

In attaining this object, the container according to the present invention is opened and respectively closed by sliding in the manner of a drawer a part of the blank which is mounted on another part thereof, this sliding causing a mobile terminal part of the container, formed integrally with the flat blank, to open and close respectively. The container according to the invention also possesses numerous constructional characteristics which make it of easy and reliable assembly, either manually or by using automatic or semiautomatic sequentially operating machines.

DESCRIPTION OF THE DRAWINGS

The container according to the invention is described in detail hereinafter with reference to the accompanying drawings, in which.

DETAILED DESCRIPTION

Figure 1:
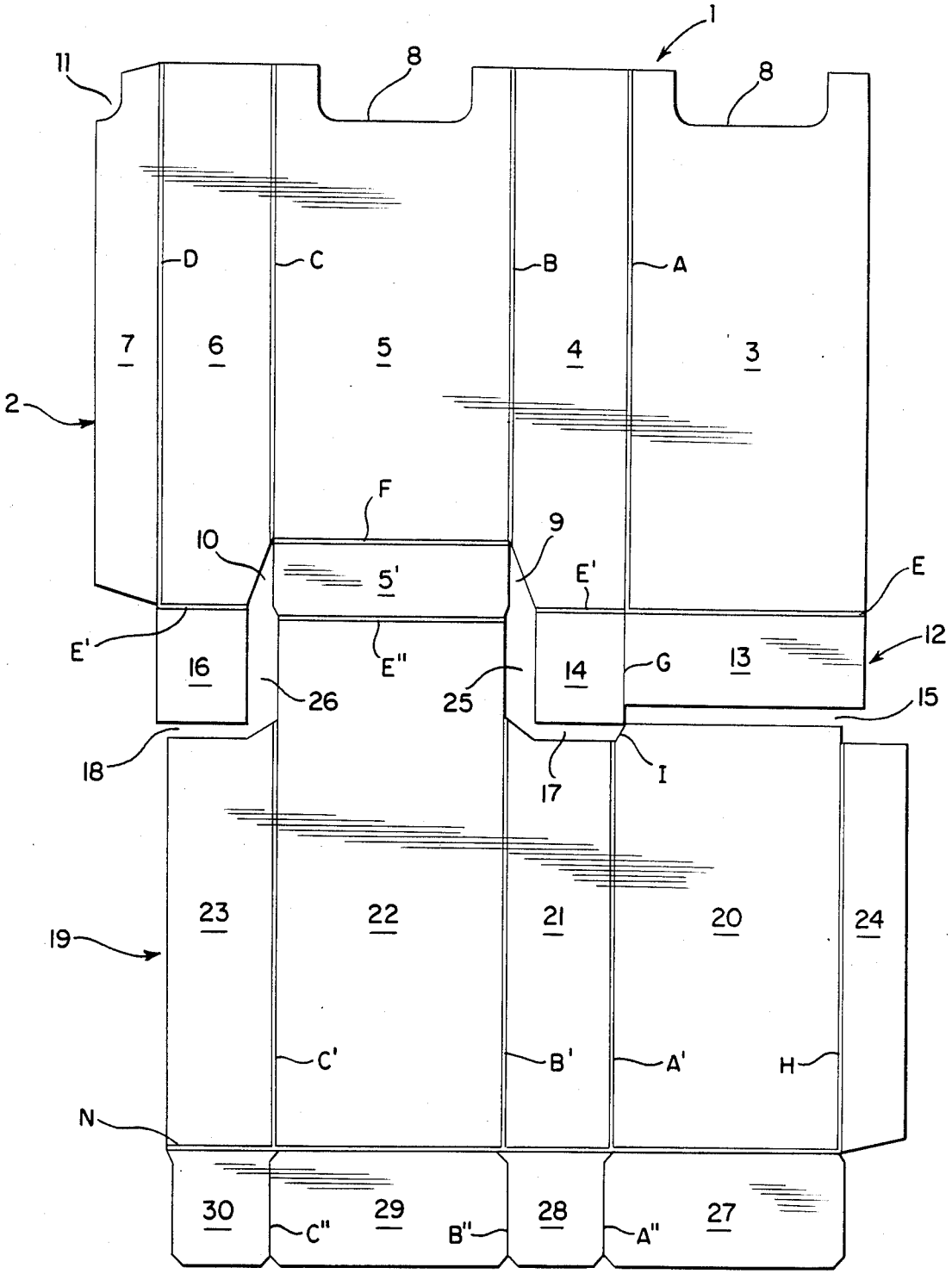
FIG. 1 is a plan view of the inside face of the flat, one-piece, die-cut blank which is to form a first embodiment of the container according to the invention.

With reference to FIG. 1, the flat, one-piece die-cut blank for forming a first embodiment of a container according to the invention comprises:

an upper part 2, for forming the outer casing of the assembled container and divided by longitudinal creasing lines A, B, C into alternately-disposed major panels 3, 5 and minor panels 4, 6 of substantially rectangular shape.

The two specularly equal minor panels 4 and 6 for forming the side walls of the outer casing of the assembled container comprise, in their lower part starting from the creasing lines B and C respectively, opposing chamfered corners delimiting triangular cut-out zones 9 and 10.

The end major panel 3, for forming the outer base surface of the assembled container, has the same length as the minor panels 4 and 6 but is of considerably greater width.

The major panel 5 disposed between the minor panels 4 and 6 and designed to form the outer upper surface of the assembled container has a width equal to the width of the major panel 3, a length less than the length of the panels 3, 4 and 6, and is limited lowerly by the transverse creasing line F, which joins the upper vertices of the triangular cut-out zones 9 and 10 and connects the major panel 5 to the underlying rectangular lower panel 5', which is of the same width but of considerably smaller length than said major panel 5, such that the sum of the lengths of said panels 5 and 5' is slightly greater than the length of any one of the panels 3, 4 and 6.

The upper free edges of the major panels 3 and 5 each comprise a recess 8, the purpose of which is to facilitate the gripping of the inner casing of the assembled container, as is described hereinafter.

A further longitudinal creasing line D delimits a lateral end flap 7 which is to have adhesive applied to its rear for its sticking on to that surface of the major panel 3 shown in the figure along its longitudinal zone adjacent to its outer edge. Said lateral end flap 7 is substantially tapered outwards and in its upper edge comprises a recess 11 having the same shape as that part of the recess 8 of the major panel 3 disposed close to its outer lateral edge, so that the said part of the recess 8 of the major panel 3 and the recess 11 of the lateral end flap 7 coincide on assembly.

a central part 12 comprising: a major end rectangular panel 13 aligned with the major panel 3 of the upper part 2, and joined to it by the transverse creasing line E, and having the same width thereas but having a length equal to the minimum width of the lower part of the minor panels 4 and 6 of the upper part 2; two equal rectangular minor panels 14 and 16 having a width equal to the minimum width of the lower part of said panels 4 and 6, with which they are respectively aligned and to which they are joined by the transverse creasing lines E', and thus equal to the length of the major panel 13 of the central part 12. Said panels 14 and 16 have a length equal to one half the width of the major panel 13 and are to be stuck on to that surface of said major panel 13 shown in the figure, to which adhesive is suitably applied.

a lower part 19 to form the inner casing of the assembled container, and divided by longitudinal creasing lines A', B', C', which are substantially aligned with the corresponding longitudinal creasing lines A, B, C of the upper part 2, into major rectangular panels 20, 22 and minor rectangular panels 21, 23 which are substantially aligned with the corresponding panels 3, 5 and 4, 6 of the upper part 2 and being of equal widths alternately in pairs, these widths being slightly less than the width of the corresponding panels of the upper part 2 so as to allow them to slide when the container is assembled.

The minor panels 21 and 23, for forming the side walls of the inner casing of the assembled container, have equal dimensions and upperly delimit spaces 17, 18 of separation from the minor spaces 14, 16 of the central part 12, with which they are aligned. These are also suitably dimensioned relative to the corresponding panels 4 and 6 of the upper part 2 to allow axial sliding of the two assembled container parts.

The major panel 20, for forming the base surface of the outer casing of the assembled container, has an upper corner chamfered by the cutting line I, extending upwards from the creasing line A', to prevent any interference with the minor panel 14. Said major panel 20 is separated upperly from the corresponding major panel 13 of the central part 12 by the empty space 15 formed by the die-cutting operation.

The central major panel 22, for forming the upper surface of the inner casing of the assembled container, is aligned with the central major panel 5 and thus with the lower panel 5' of the upper part 2, and is connected to this latter by the transverse creasing line E", its width being equal to the width of the major panel 20 and its length being substantially equal to the sum of the lengths of the major panel 5 and lower panel 5' of the upper part 2.

Empty spaces 25, 26, formed by die-cutting and consecutive to the triangular cut-outs 9 and 10 laterally separate the upper part of the major panel 22 of the lower part 19 from the minor panels 14 and 16 of the central part 12. A further longitudinal creasing line H, parallel to the longitudinal creasing lines A', B', C', delimits a lateral end flap 24 joined to the major panel 20 and thus situated on the opposite side to the lateral end flap 7 of the upper part 2. That surface of said lateral end flap 24 shown in the figure is coated with adhesive for its sticking on to the rear of the minor panel 23.

major appendix panels 27 and 29 and minor appendix panels 28 and 30 of equal length equal to the width of the minor panels 21 and 23 of the lower part 19 and delimitated upperly by the transverse creasing line N which joins them to the lower part 19 of the flat blank 1, they being aligned respectively with the panels 20, 22 and 21, 23 of the lower part 19 and being separated from each other by longitudinal cuts A", B", C" which constitute the ideal prolongation of the longitudinal creasing lines A', B', C' of said lower part 19. Points or layers of adhesive are applied to the rear of the major appendix panel 29 for its sticking on to that surface of the major appendix panel 27 shown in the figure.

Again with reference to FIG. 1, the flat blank 1 is printed, folded, stuck down and assembled as follows.

The lower part 19 of the flat blank 1 as shown in the figure (which shows the inside face) is to be folded upwards and rearwards towards the surface of the upper part 2 shown in the figure, along the transverse creasing line E" which joins the lower panel 5' of the upper part 2 to the major panel 22 of the lower part 19. A part of that surface of the lower part 19 shown in the figure will thus lie on the outside of the assembled container, and the rear of that surface of the upper part 2 shown in the figure and the rear of the major panel 13 of the central part 12 will form the outer surface of the container. Consequently, the upper part 2 and the major panel 13 of the central part 12 will be printed on the outside face (i.e. on the cover) whereas any required printing on visible zones of the remainder of the flat blank 1 will be done on the inside face.

The flat blank printed in this manner is now assembled by folding the lower part 19 upwards and rearwards along the transverse creasing line E" which connects the lower panel 5' of the upper part 2 to the upper part of the major panel 22 of said lower part 19.

The result of this folding operation is that that surface of the lower part 19 shown in the figure becomes superposed on and in contact with that surface of the upper part 2 shown in the figure, whereas the panels 13, 14, 16 of the central part 12 maintain their initial position together with the upper part 2 after this folding.

A layer of vinyl or hot melt adhesive is applied manually or by machine to the rear of the lateral end flap 7 of the upper part 2 and to that surface of the lateral end flap 24 of the lower part 19 which is shown in the figure.

The flat blank 1 folded in this manner is further folded forwards firstly along the longitudinal creasing lines A, A' which have become superposed after folding the lower part 19 on to the upper part 2, and then again forwards along the longitudinal creasing lines C, C' which have become likewise superposed. The adhesive-coated lateral end flap 24 of the lower part 19 is then stuck on to the rear of a longitudinal zone adjacent to the outer edge of the minor panel 23 of said lower part 19, and the rear of the adhesive-coated lateral end flap 7 of the upper part 2 is stuck on to a longitudinal zone adjacent to the outer edge of the major panel 3 of said upper part 2.

The flat blank folded and stuck together in this manner gives rise to a two-dimensional foldable container of minimum bulk and thus simple to trasport and store, and which is ready for simple transformation into a three-dimensional container by exerting a manual or mechanical pressure along the opposing edges of the container corresponding to the superposed longitudinal creasing lines A, A' and C, C' to thus obtain a parallelepiped container which is open at its ends.

The rear part of the container is closed by folding the minor appendix panels 28 and 30 inwards, folding the major appendix panel 27 until it contacts the minor appendix panels 28 and 30, and folding the major appendix panel 29 until it contacts the major appendix panel 27, the folding being done along the respective portions of the creasing line N, then applying a layer of adhesive to the rear of the major appendix panel 29, and then sticking the adhesive-coated rear of this latter on to the major appendix panel 27 by applying pressure.

The chosen product is placed in the container arranged in this manner, the rectangular lower panel 5' is folded inwards so as to pass over the chamfers of the triangular zones 9 and 10, the minor panels 14 and 16 are folded inwards along the creasing lines E', a layer of adhesive is applied to that surface of the major panel 13 shown in the figure, and this is folded along the creasing line E towards the minor panels 14 and 16, and then stick on to the rear of these latter.

This first embodiment of the invention is thus finally assembled into its closed position. An adhesive sealing tab, stamp or label or the like can be applied between the lower panel 5' of the upper part 2 and the major panel 13 of the central part 12, or between the lower part 19 below the recess 8 and the adjacent outer surface of the upper part 2, to ensure that the package has not been tampered with when sold.

Figure 2:
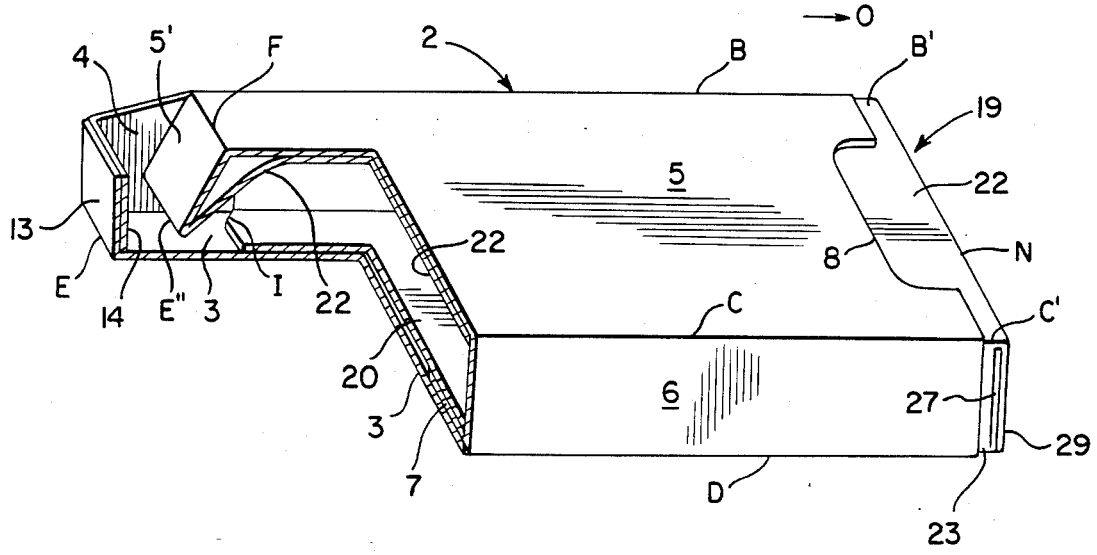
FIG. 2 is a partly sectional perspective side view of the container obtained from the flat blank of FIG. 1 in its assembled form.
Figure 3:
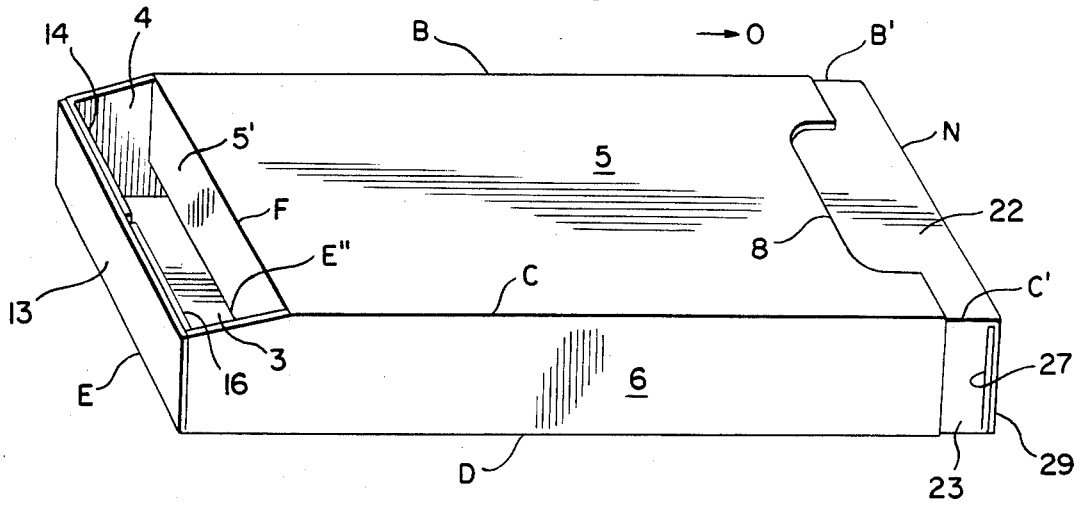
FIG. 3 is a perspective side view of the container of FIG. 2 partly open.
Figure 4:
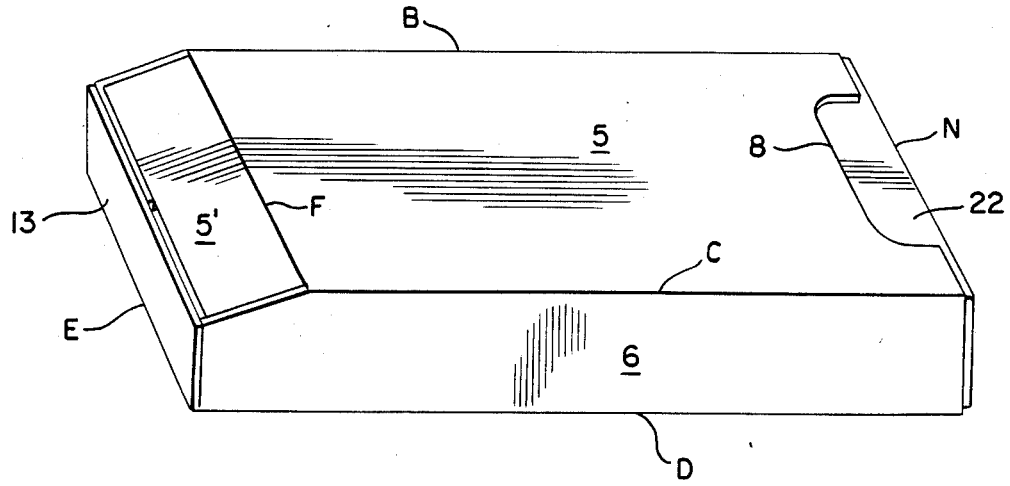
FIG. 4 is a perspective side view of the container of FIG. 2, in its closed position.

To open the container, it is necessary only to break any guarantee seal, then to grip the opposing major panels 20 and 22 of the inner casing of the container formed by the lower part 19 of the flat blank 1, between the fingers in those zones left uncovered by the profiled recesses 8 of the outer casing of the container formed by the upper part 2, and then slide the assembled inner lower part 19 in the only possible direction, i.e. outwards from the container as shown by the arrow 0 in FIGS. 2 and 3.

By means of this substantially drawer-like sliding, the major panel 22 of the lower part 19 of the flat blank 1 causes the lower panel 5' of the upper part 2, which is rigid therewith along the trasverse creasing line E", to rotate about the transverse creasing line F until an end position of maximum opening is reached in which the major panel 22 of the lower part 19 and the lower panel 5' of the upper part 2 are substantially aligned, such that that surface of the lower panel 5' shown in FIG. 1 is substantially in contact with that surface of the major panel 5 shown in FIG. 1 on a zone adjacent to the transverse creasing line F.

The product contained in the container can then be withdrawn through the aperture thus defined between the creasing line F and the free depressed edge of the mutually rigid panels 13, 14, 16, without danger of the product being able to fall out, also in case of limited inclinations of the container.

The container can then be again closed to await subsequent product withdrawal by simply sliding the inner casing into the outer casing in the reverse direction to the arrow 0 in the manner of a drawer, so that the major panel 22 urges the lower panel 5' outwards to cause it to rotate about the transverse creasing line F until that portion of the transverse creasing line E" which joins the major panel 22 of the inner casing to the lower panel 5' of the outer casing again comes into contact with the depressed free edges of the panels 14, 16, which are mutually rigid by way of the panel 13, i.e. substantially in line with the free edges of the chamfered corner ends 9 and 10 of the lateral walls formed by the minor panels 4 and 6, thus closing the container tightly by virtue of the fact that the lower panel 5' presses against the aforesaid depressed free ends, this pressing action being obtained by virtue of the fact that the total length of the major panel 5 plus lower panel 5' of the upper part 2 which form the upper surface of the outer casing of the container is slightly greater than the length of the opposing panel 3 which forms the lower surface of said outer casing.

A second embodiment of the container according to the invention will now be described in detail with reference to FIGS. 5 to 8. In these figures, elements similar to those of the preceding figures are indicated by the same reference letters and numerals in hundreds.

Figure 5:
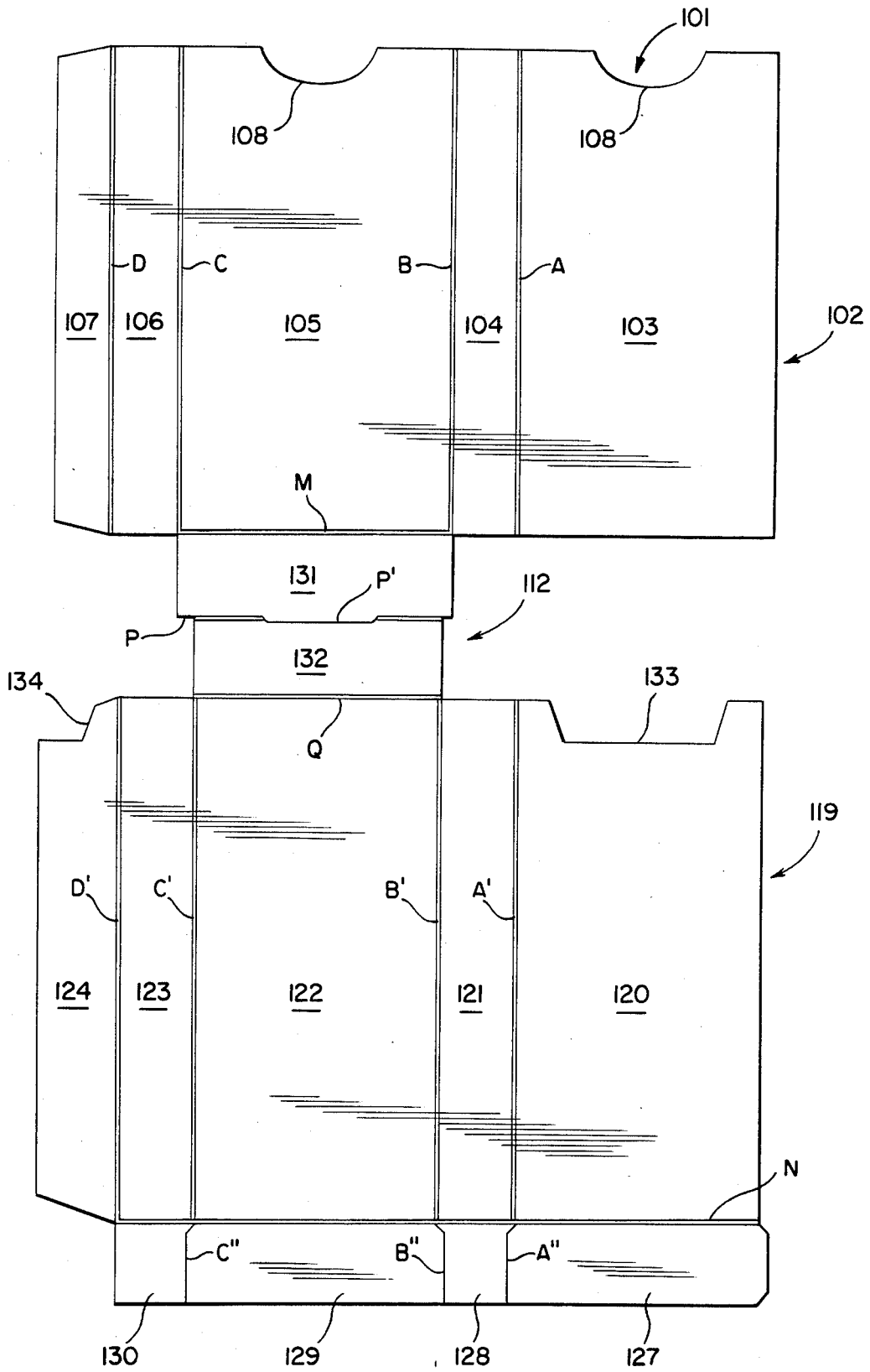
FIG. 5 is a plan view of the inside face of the flat, one-piece blank for forming a second embodiment of the container according to the invention.

More particularly, with reference to FIG. 5, the flat, one-piece, die-cut blank 101 for forming a substantially parallelepiped container comprises:

an upper part 102 for forming the outer casing of the assembled container, divided by parallel longitudinal creasing lines A, B, C into substantially rectangular major panels 103 and 105 and minor panels 104 and 106, which are of equal length, and alternately of equal width in pairs. A further longitudinal creasing line D delimits an outwardly tapered lateral end flap 107 to be coated on its rear with adhesive for its sticking on to that surface of a longitudinal zone adjacent to the edge of the major panel 103 shown in the figure.

The widths of the major panels 103 and 105, which are to form respectively the base and upper surface of the outer casing of the assembled container, are substantially equal to each other and considerably greater than their adjacent minor panels 104 and 106 which are to form the lateral walls of the outer casing of the assembled container.

The upper free edges of the major panels 103 and 105 comprise a recess 108, the purpose of which has already been described with reference to the first embodiment of the invention.

a central part 112 comprising in succession an upper rectangular panel 131 and a lower rectangular panel 132, which are aligned longitudinally with the major panel 105 of the upper part 102.

The upper panel 131 is delimited upperly by the transverse creasing line M which connects it to the major panel 105 of the upper part 102, and is delimited lowerly by the transverse creasing line P which connects it to the successive lower panel 132, said transverse creasing line P comprising a suitably shaped cut P' in its central part. The width of the upper panel 131 is equal to the sum of the width of the major panel 105 of the upper part 102 and its creasing-line thicknesses, and its length is equal to the width of the minor panels 104 and 106 of the said upper part 102; the width of the lower panel 132 is slightly less than the width of the upper panel 131, whereas its length is the same.

a lower part 119 for forming the inner casing of the assembled container, and divided by the parallel longitudinal creasing lines A', B', C', aligned with the corresponding longitudinal creasing lines A, B, C of the upper part 102, into major rectangular panels 120 and 122 and minor rectangular panels 121 and 123, which are aligned with the corresponding rectangular panels 103, 105 and 104, 106 of the upper part 102, and are alternately of equal width in pairs, these widths being slightly less than the widths of said panels 103 to 106.

The lower part 119 is connected to the central part 112 by the transverse creasing line Q which joins the major panel 122 of the lower part 119 to the lower panel 132 of the central part 112.

A further parallel longitudinal creasing line D' joins a lateral end flap 124 to the minor panel 123. That surface of said lateral end flap 124 shown in FIG. 5 is to receive adhesive for its sticking on to the rear of the major panel 120.

The major panels 120 and 122 of the lower part 119, which are aligned respectively with the major panels 103 and 105 of the upper part 102, are to form the opposing major surfaces of the inner casing of the assembled container. The upper edge of the major panel 120 also comprises a substantially trapezoidal cavity 133 acting as a lead-in for withdrawing the product when the container is open.

The outwardly tapered lateral end flap 124 therefore has its upper edge shaped with a recess 134 of the same shape as that part of the recess 133 of the major panel 120 which is close to its outer lateral edge to allow suitable superposing on assembly.

The minor panels 121 and 123 of the lower part 119, which are aligned with the minor panels 104 and 106 of the upper part 102, are to form the lateral walls of the inner casing of the assembled container.

Major appendix panels 127 and 129 and major appendix panels 128 and 130 of equal length, substantially equal to the length of the minor panels 121, 123 of the lower part 119, and delimited upperly by a transverse creasing line N joining them to said lower part 119 of the flat blank 101, they being aligned respectively with the panels 120, 122 and 121, 123 of the lower part 119 and separated from each other by longitudinal cuts A", B'', C'' which constitute the ideal prolongation of the longitudinal creasing lines A', B', C' of the lower part 119. The width of the appendix panels 127 to 130 is substantially equal to the width of the corresponding panels 120 to 123 of the lower part 119.

Points or layers of adhesive are provided on the rear of the appendix panel 127 for its sticking on to that surface of the appendix panel 129 shown in the figure.

When the flat blank 101 has been printed in a manner substantially similar to that already described in relation to the flat blank 1, it is assembled by folding the lower part 119 together with the panel 132 of the central part 112 upwards and rearwards along the transverse creasing line P which joins the upper panel 131 to the lower panel 132 of the central part 112. By this folding action, those surfaces of the lower panel 132 of the central part 112 and of the lower part 119 shown in the figure become superposed on and in contact with those surfaces of the upper panel 131 of the central part 112 and, respectively, of the upper part 102 shown in the figure.

A layer of vinyl or hot melt adhesive is applied manually or by machine to the rear of the lateral end flap 107 of the upper part 102 and to that surface of the lateral end flap 124 of the lower part 119 shown in the figure.

The flat blank 101 is now folded forwards firstly along the longitudinal creasing lines C and C', which had become superposed when the lower part 119 was folded on to the upper part 102, and then forwards along the superposed longitudinal creasing lines A and A', taking care that the adhesive-coated lateral end flap 124 sticks on to the rear of a longitudinal zone adjacent to the edge of the major panel 120, both these pertaining to the lower part 119, and that the adhesive-coated lateral end flap 107 of the upper part 102 becomes inserted between those surfaces of the major panel 120 of the lower part 119 and of the major panel 103 of the upper part 102 which are shown in the figure, and that it becomes stuck along a longitudinal zone adjacent to the edge of said major panel 103.

Pressure is then applied to finally stick down the lateral end flap 124 on to the rear of the major panel 120 of the lower part 119, and the rear of the lateral end flap 107 on to the major panel 103 of the upper part 102.

When the flat blank 101 is folded and stuck together in this manner, it gives rise to a two-dimensional foldable container of minimum bulk and thus simple to transport and store, and ready for easy transformation into a three-dimensional container by manually or mechanically applying a pressure along the opposing corners of the container corresponding to the longitudinal superposed creasing lines A, A' and C, C', to thus obtain a parallelepiped container open at its ends.

Adhesive is applied to the rear of the major appendix panel 127, the minor appendix panels 128 and 130 are then folded inwards, the major appendix panel 127 is folded until it comes into contact with the minor appendix panels 128 and 130 and the major appendix panel 129 is folded until it comes into contact with the major appendix panel 127, the folds being made along the respective portions of the transverse creasing line N, after which the major appendix panel 129 is stuck down on to the rear of the adhesive-coated major appendix panel 127 by applying pressure. This further embodiment of the container according to the invention thus becomes finally assembled in its open position.

Figure 6:
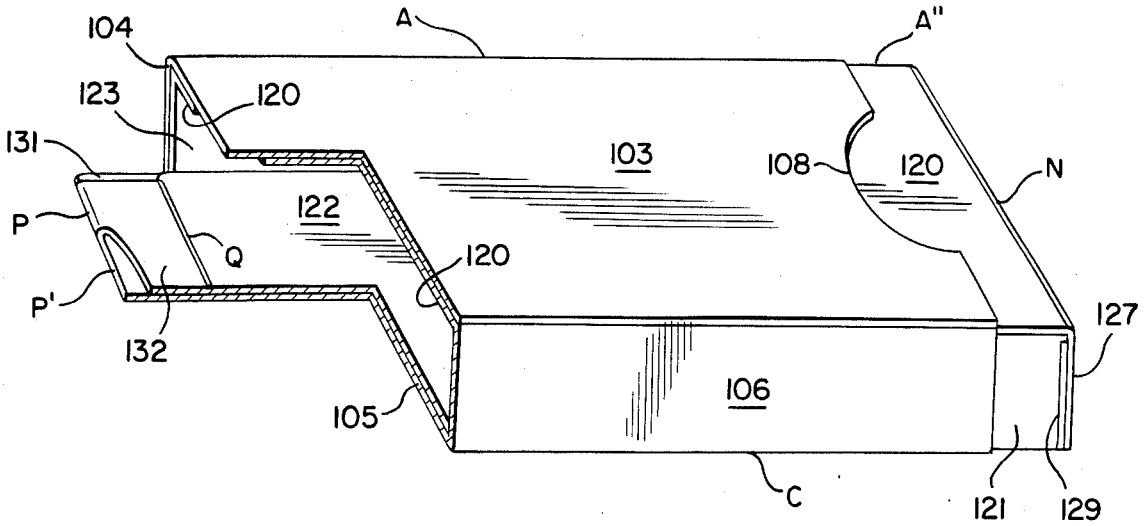
FIG. 6 is a partly sectional perspective side view of the container obtained from the flat blank of FIG. 5 in its assembled form.
Figure 7:
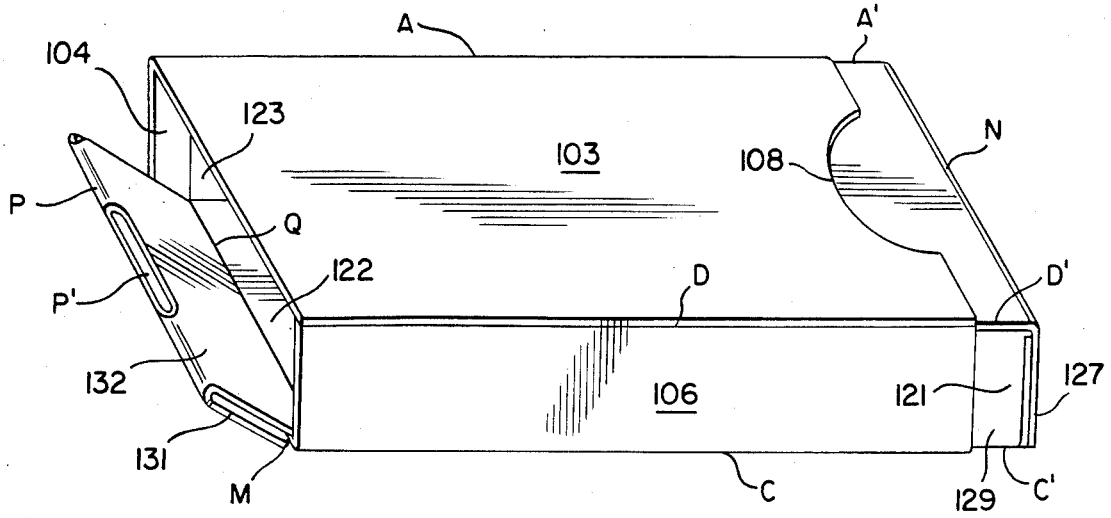
FIG. 7 is a perspective side view of the container of FIG. 6 partly open.
Figure 8:
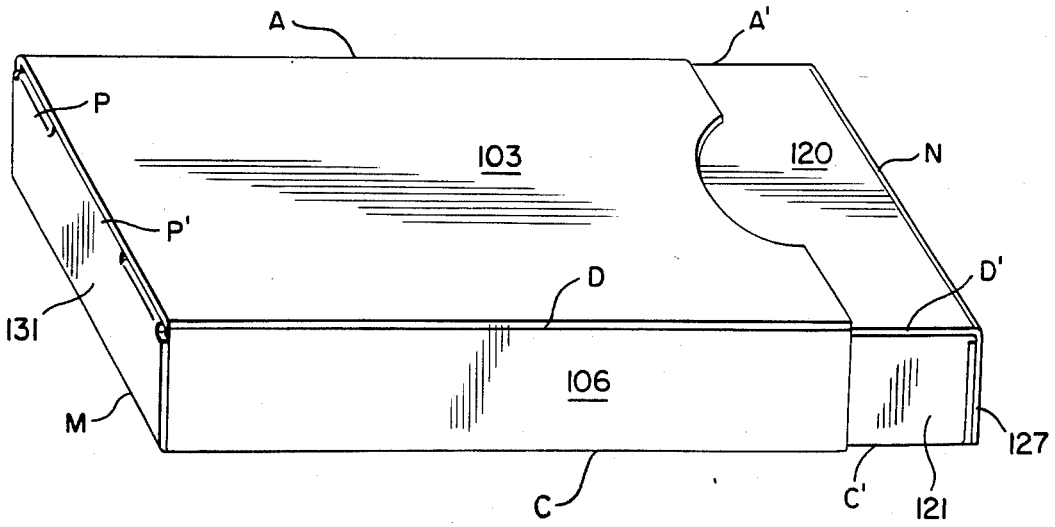
FIG. 8 is a perspective side view of the container of FIG. 6, in its closed position.

Referring now to FIGS. 6 to 8, which show the container obtained from the flat blank of FIG. 5 in its position of use, the container is filled with the chosen product manually or by machine.

The container is closed as follows.

The inner casing of the container, formed from the lower part 119 of the flat blank 101, is slid while inside the outer casing, formed from the upper part 102, in the only possible direction, i.e. outwards from the container as indicated by the arrow R of FIG. 7.

By means of this substantially drawer-like sliding action, the lower panel 132 of the central part 112, which is joined to the inner casing formed from the lower part 119 by the transverse creasing line Q, is pulled into the container and simultaneously rotated about the transverse creasing line Q towards the container body until it rests against its aperture by virtue of being connected to the upper panel 131 by the transverse creasing line P. This movement causes the upper panel 131 to simultaneously rotate through 90° about the transverse creasing line M until said panel 131 assumes a position such that its lateral edges and the cut portion P', which project beyond the edges of the aperture in the assembled container, come into contact with and rest against said edges of said aperture. The lower panel 132 assumes inside the container an obligatory oblique position which protects it against accidental opening due to the internal pressure of the product.

The thus assembled container can then be sealed by known means such as adhesive tabs, stamps or labels applied between the mobile side and the container body or between the lower part 119 below the recess 118 and the adjacent surface of the upper part 102, to ensure that the package has not been tampered with when sold.

To open this second embodiment of the container according to the invention, it is necessary only to break any guarantee seal and then to slide the inner casing within the outer casing in the opposite direction to the arrow R. In this manner, the major panel 122 pushes against and rotates the lower panel 132, which itself pushes the upper panel 131 outwards. The lower panel 132 and upper panel 131 rotate together about the respective transverse creasing lines Q and M, until the front panel 132 has rotated through about 180°.

The subsequent opening and closing operations fot withdrawing the product as required by the user are always carried out by simply sliding the inner casing formed from the lower part 119 of the flat blank 101 within the outer casing formed from the upper part 102.

Numerous modifications can be made to the container according to the invention with regard for example to the shape of the container cross-section, its dimensions or the material used for forming the flat blank, without leaving the scope of protection of the invention itself.

What is claimed is:

1. A container, in particular, for loose confectionery products such as chocolates, caramels, tablets, sugar-coated pills or the like, said container comprising:

two casings axially slidable one within the other, being formed from a flat, one-piece, die-cut blank and having a mobile end part rotatable to open and close said container, said die-cut blank including an upper part for forming an outer one of said casing of an assembled container and said upper part being divided by longitudinal parallel creasing lines into substantially rectangular minor panels and substantially rectangular major panels spaced alternately of equal width in pairs, said minor panels and a terminal one of said major panels being of equal length, said minor panels, forming lateral walls of said outer casing, having opposing lower corners chamfered to define triangular spaces disposed symmetrically about an intermediate one of said major panels, said intermediate major panel being delimited lowerly by a transverse creasing line joining together upper vertices of said triangular spaces and delimiting a lower panel of the same width as said intermediate major panel but of a length such that the sum of a length of said intermediate major panel and said length of said lower panel is slightly greater than a length of the remaining panels, said major panels, forming upper and lower surfaces of said outer casing including outer upper edge recesses shaped to enable an inner casing to be gripped, and a terminal one of said minor panel being joined by a further longitudinal creasing line to a lateral end flap tapering substantially outwardly and having an upper corner profiled to the same shape as said recess located at said upper edge of said major panels, a rear surface of said lateral end flap being adapted to be coated with adhesive for sticking on to a front surface of said terminal major panel during assembly, a central part including a terminal major rectangular panel aligned with and joined by a creasing line to said terminal major panel of said upper part and having a same width as said terminal major panel of said upper part and two minor rectangular panels of said central part aligned with and joined by a creasing line to said minor panels of said upper part respectively, said minor panels of said central part having the same width as a minimum width of lower parts of said minor panels of said upper part and being of a length equal to one half the width of said major panel of said central part, a lower part for forming said inner casing of said assembled container, divided by longitudinal parallel creasing lines, aligned with corresponding longitudinal parallel creasing lines of said upper part, and dividing said lower part into rectangular minor and major panels substantially aligned with said panels of said upper part and being slightly less in width than the width of corresponding panels of said upper part, said minor panels of said lower part, forming lateral walls of said inner casing of the assembled container, and a terminal one of said major panels of said lower part being profiled to prevent interference with said minor panels of said central part, said major panels of said lower part being designed to form upper and lower surfaces of said inner casing of said container, an intermediate major panel one of said major panels of said lower part having a length substantially equal to the sum of the lengths of said intermediate major panel and said lower panel of said upper part and being joined to said lower panel by a transverse creasing line, said lower part including a lateral end flap tapered substantially outwardly and joined by a longitudinal creasing line to said terminal major panel of said lower part, said lateral end flap of said lower part being disposed on an opposite side of said flat blank to said lateral end flap of said upper part, and adapted to be coated with adhesive on a front surface for sticking on to a rear surface of a terminal one of said minor panels of said lower part, and substantially rectangular appendix panels of equal length and alternately of equal width in pairs being aligned with and of equal width to corresponding panels of said lower part, said appendix panels being separated from each other by longitudinal linear cuts which are aligned with corresponding of said longitudinal creasing lines of said lower part, said appendix panels being delimited upperly by a transverse creasing line joining said appendix panels to a lower side of said panels of said lower part, an intermediate major panel of said appendix panels being adapted to be coated with adhesive on a rear for sticking on to a front surface of a terminal major panel of said appendix panels during assembly.

2. A container according to claim 1, wherein said lower part is folded upwards and rearwards along said transverse creasing line which joins together said lower panel connected to said intermediate major panel of said upper part and said corresponding intermediate major panel of said lower part until a front surface of said lower part comes into contact with a front surface of said upper part, while said panels of said central part keep their position fixed, as does said upper part, an adhesive applied to said rear surface of said lateral end flap of said upper apart, and to said front surface of said lateral end flap of said lower part, said blank being folded forwards along superposed longitudinal creasing lines joining said intermediate minor panels of said upper part and said central part to said terminal major panels of said upper part and said central part, respectively, and being folded along superposed longitudinal creasing lines joining said terminal minor panels of said upper part and said lower part to said intermediate major panels of said upper part and said lower part, respectively, so that an adhesive-coated zone of said end flap of said lower part is stuck, by the application of pressure, onto said rear surface of said terminal minor panel of said lower part, and an adhesive-coated rear surface of said lateral end flap of said upper part is stuck, by the application of pressure, onto a corresponding longitudinal edge zone of said terminal major panel of said lower part, thus completing the enclosing of the lower part by said upper part and fixing said upper part and, respectively, said lower part to themselves, minor panels of said appendix panels are folded inwardly, and said terminal major appendix panel is folded until it mates with said minor appendix panels, and said intermediate major appendix panel is folded, adhesive-coated on its rear surface, until said intermediate major appendix panel mates with said terminal major appendix panel, superposing and sticking the adhesive-coated rear of said intermediate major appendix panel onto a front surface of the already folded terminal major appendix panel, to thus form a closed rear end of said container, said lower panel of said upper part is inwardly folded so that said lower panel passes beyond said chamfers defining said triangular spaces, and said two minor panels of said central part are inwardly folded, and said major panel of said central part is folded towards said minor panels and a front surface of said minor panels are coated with adhesive, said minor panels are superposed and stuck to a rear of said two folded minor panels, for an assembly of said container in an open position, ready for filling with a chosen product.

3. A container according to claim 2, wherein said container is selectively opened and closed by sliding said inner casing, formed from said lower part, within said outer casing formed from said upper part, with a substantially drawer-like movement, said sliding of said inner casing towards said outside of said container causing said intermediate major panel of said lower part, forming an inner upper surface of said container, to pull said lower panel of said upper part and thus cause said lower panel of said upper part to rotate about a creasing line joining said lower panel of said upper part to said intermediate major panel of said upper part, until said lower panel of said upper part reaches a position of maximum opening of said container where said intermediate major panel of said lower part and said lower panel of said upper part are substantially aligned with each other and parallel to said intermediate major panel of said upper part, thus leaving free an aperture for removing said product, whereas sliding said inner casing in a reverse direction, causes said lower panel of said upper part to become repositioned firmly against a wall formed by said minor panels of said central part which are joined together by said major panel of said central part, thus tightly closing the container.

4. A container according to claim 3, wherein lower parts of said minor panels of said upper part have opposing corners chamfered and said panels of said central part define, when said container is assembled, a compartment for enabling said product to be withdrawn, while at the same time preventing accidental falling of the product from said compartment, even when said container is inclined.

* * * * *